United States Patent [19]

Rupp

[11] 4,320,610

[45] Mar. 23, 1982

[54] SIMULATED LOG CORNER UNITS FOR ERECTING LOG CABIN TYPE STRUCTURES

[76] Inventor: Kenneth R. Rupp, Rte. 1, Florissant, Colo. 80816

[21] Appl. No.: 168,430

[22] Filed: Jul. 10, 1980

[51] Int. Cl.[3] ..... E04B 1/10

[52] U.S. Cl. ..... 52/233; 52/282

[58] Field of Search ..... 52/233, 282, 311, 313; 46/20

[56] References Cited

U.S. PATENT DOCUMENTS

| | | | |
|---|---|---|---|
| 1,654,120 | 12/1927 | Ewing | 52/233 |
| 1,655,701 | 1/1928 | Hyland et al. | 52/233 |
| 1,841,127 | 1/1932 | Ilson | 52/313 X |
| 2,787,029 | 4/1957 | Johnson | 52/233 |
| 3,979,862 | 9/1976 | Hamilton et al. | 52/233 X |
| 4,096,674 | 6/1978 | Kollar et al. | 46/20 X |
| 4,154,036 | 5/1979 | Moss et al. | 52/282 |

FOREIGN PATENT DOCUMENTS

| | | | |
|---|---|---|---|
| 186837 | 6/1907 | Fed. Rep. of Germany | 52/233 |

*Primary Examiner*—J. Karl Bell

*Attorney, Agent, or Firm*—W. Britton Moore

[57] ABSTRACT

Simulated log corner units for constructing log cabin type structures from preformed log siding, which units are arranged on a foundation at the corners thereof and each include a vertically disposed beam to which a series of relatively short alternately arranged log end pieces are offsettedly attached so as to alternately project forwardly and laterally therefrom at right angles to each other at each corner and simulate the ends of the siding logs so as to be compatible with the log type siding applied to the exterior walls of the structure and the latter will have the appearance of a conventionally erected log cabin.

9 Claims, 10 Drawing Figures

SIMULATED LOG CORNER UNITS FOR ERECTING LOG CABIN TYPE STRUCTURES

BACKGROUND OF THE INVENTION

This invention relates to log corner units for use in restructuring old structures and erecting new log cabin type structures.

While it has long been the practice to erect buildings and other structures from regular and preformed logs, it has been difficult to assemble, intersect, and interconnect the log siding members at each of the corners so that the structure will have a neat appearance and structurally sound corner construction.

SUMMARY OF THE INVENTION

The principal object of the present invention is to provide log corner units arranged at the corners of and supported by a foundation of old or new structures, and to which preformed log siding members are butted to construct log cabin type structures employing the latest construction techniques with the enchantment and appealing warmth of log craftsmanship.

Another object is the provision of log corner units each embodying a vertically disposed beam to which a series of relatively short log end pieces are offsettedly attached so as to alternately project forwardly and laterally therefrom at right angles to each other and to which the log type siding courses of the exterior walls are butted to provide the finished appearance of a log cabin.

Still another object is to provide log corner units each including an elongated, generally square-shaped, and pre-drilled wooden beams to enable the snug fitting thereagainst and attachment thereto by lag screws and adhesive of the log end pieces.

A further object is the provision of log corner units which, when assembled on a structural foundation with the usual framing arranged therebetween, will enable the erection and assembly of the usual exterior sheathing and interior paneling with insulation therebetween, and the attachment thereto of log siding complementary to and extending horizontally between the end pieces hereof.

A still further object is to provide log corner units wherein the right angularly extending log end pieces thereof are so arranged thereon that each course of log siding extending between corner units butts thereagainst and is adhesively secured thereto creating single units out of each course of log and siding and adding strength and stability to the erected structure.

Another object is the provision of log corner units wherein the weight of the log end pieces thereof bear directly on the structural frame work and eliminate stress on the log siding attached thereto.

A further object is to provide log corner units which are adaptable to the variously shaped logs produced by different manufacturers and which units are used on both new and old constructions.

Still a further object is the provision of log end pieces so attached to each corner unit that they are offset from the adjacent vertical side faces thereof and enable the complementary log siding to butt up flush therewith.

These and other objects and advantages will be apparent as the specification is considered with the accompanying drawings, wherein FIG. 1 is an isometric view of the corner of a log cabin type structure being erected, partly in section, to show the framing, interior paneling, exterior sheathing, and insulation therebetween;

FIG. 2 is an end elevational view of a log corner unit;

FIG. 3 is a front elevation of a portion of a corner unit arranged at the left front or right rear of a structure, showing the relationship of two of the end pieces complementary to the siding log courses extending horizontally across the front and rear of the structure, and an end piece interposed therebetween and complementary to a siding log course extending horizontally across the left side thereof;

DETAILED DESCRIPTION

Figure 1:
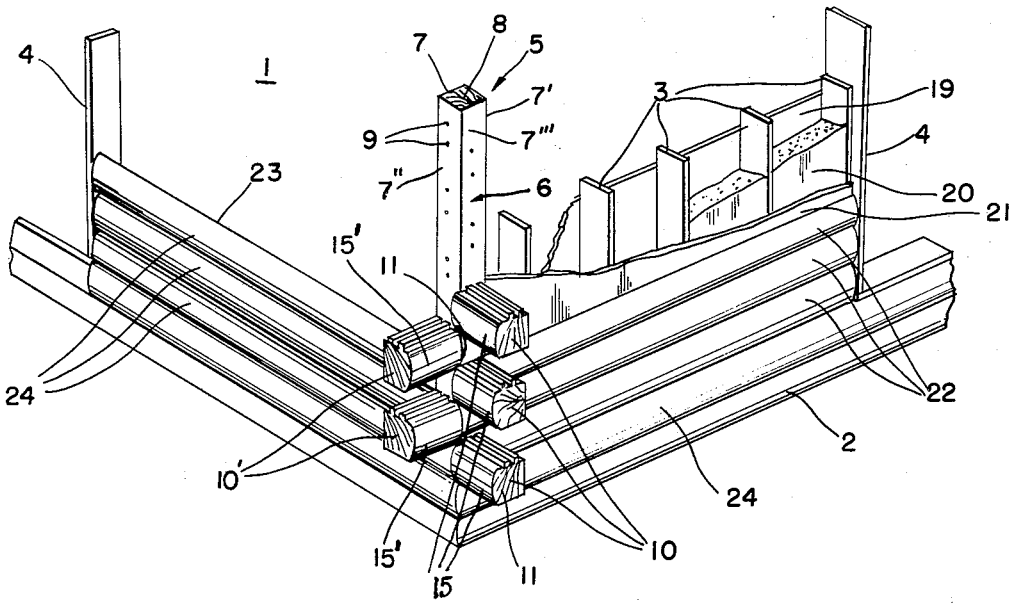

Referring more particularly to the drawings, wherein similar reference characters designate like parts throughout the several views, numeral 1 identifies a building structure of the log cabin type being erected and including a suitable and appropriate masonry or the like foundation or footing 2 for supporting the usual floor, not shown, and the usual upstanding 2×4 or 2×6 wall framing 3, and door and window jambs 4 erected in the usual manner, and only a representative few of which are shown in FIG. 1.

This invention relates to vertical corner assembly units arranged at each corner of and suitably fixedly attached to and supported by the foundation and floor framing thereat and to which the exterior log siding is attached, as presently will be described. For example, in a rectangularly-shaped structure embodying four corners, it will be understood that a corner assembly unit will be arranged at each corner. As the corner units at two opposing corners are identical, with the other two opposing corners being mirror images, only one corner unit has been specifically illustrated and will now be described, such as that arranged at the left front corner of the structure shown in FIG. 1.

Such a corner assembly unit 5 includes an upstanding 4x4 beam 6, which may be of wood and suitably attached to the floor or framing, of a length suitable to extend from floor to the ceiling or the roof supporting framing, neither of which is shown. The beam 6 is formed with four flat side walls, including inside walls 7-7' and outside walls 7''-7''', and flat end walls 8. Each beam 6 is drilled to provide a series of spaced pairs of bores 9 extending therethrough, from the two inside walls 7-7' to the oppositely disposed outside walls 7''-7''', so that the pairs of bores 9 are spacedly arranged throughout the length of the beam and will be offset and alternately extend at right angles with respect to each other. A series of relatively short, log-shaped, end pieces 10 and 10', also of wood, are of a shape to correspond with and complement the siding being employed, with representative shapes of corner end pieces being illustrated in the various FIGS. hereof. A flat end 11 of each piece 10-10' is alternately aligned with each pair of bores 9 in the ouside beam walls 7''-7''', and a series of lag screws 12, which may be 5/16×8 in size, extend through each of the pairs of bores 9 and are screwed into a flat inner end 11 of and fixedly attach each of the end pieces 10-10' to the beam, in an obvious manner. A suitable adhesive, not shown, such as an aliphatic resin glue, may also be applied to the flat inner ends of the end pieces to reinforce the lag screws in securely and fixedly bonding the corner end pieces to the beams. Thus, as will be apparent from FIGS. 1 and 2, the end pieces 10-10', at the two front corners of the structure, will alternate in projecting forwardly and laterally or outwardly at right angles to each other, with the uppermost end piece 10 and each alternate piece 10 therebelow projecting forwardly, and the next succeeding end piece 10' and each alternate piece 10' therebelow projecting laterally. In this embodiment, each of the end pieces 10-10' is formed with flat upper and bottom walls 13 and 14, a convex exterior side wall 15, and an oppositedly disposed flat side wall 16. As the corner pieces 10 and 10' alternately project forwardly and laterally, the former will be aligned with and in effect be extensions of every other course of siding on the left side so that the convex exterior walls 15 coincide with and complement the contour of that siding, whereas the corner pieces 10' project laterally so they and their convex exterior walls 15' are correspondingly aligned with alternate courses of front wall siding. If desired, the upper face of each end piece may be formed with spaced parallel splines 17 with spaced parallel grooves 18 being provided in the flat bottom wall 14.

From the foregoing, it will be understood that the respective end pieces are so aligned with the siding courses as to give the appearance of the latter being formed of similarly shaped logs which overlap and intersect at the corners. That is, the corner assembly end pieces 10-10' appear to be the overlapping and intersecting ends of the siding.

As is customary, interior sheetrock or log paneling 19 is suitably attached interiorly to the studs of wall framing 3 and extends between the corner assembly units 5, with batts or other suitable insulation material 20 usually being arranged between the framing studs. Flat exterior sheathing panels 21 are suitably attached to the outer ends of the framing studs and extend across the walls between the corner units so that the framing and insulation will be interposed between sheetrock 19 and sheathing 21.

Elongated strips or slabs 22, of wood or other suitable preformed siding of a width generally corresponding to that of the end pieces 10-10' of the corner assembly units, are formed with flat interior faces 23 and exterior faces 24 complemental to that of the exterior faces 15-15' of end pieces 10-10'. The flat interior faces 23 are positioned against and span the exterior sheathing 21 and may be suitably nailed or otherwise attached thereto and extend transversely of the walls between the corner assembly units and butt up flush and are adhered to the corner end pieces by any suitable adhesive, such as aliphetic resin glue. Thus, as the siding covers each wall in adjacent horizontal courses, it follows that each course of siding and interconnected log end pieces constitutes an individual integral unit with an attendant increase in strength. For example, when the corner assembly units of FIGS. 1–3 are employed, wherein the end pieces 10-10' are generally rectangular with exterior convex walls, the exterior convex walls 24 of the siding courses 22 will be on a plane and correspond therewith so that the siding resembles uncut or whole logs, in an obvious manner.

Figure 4:
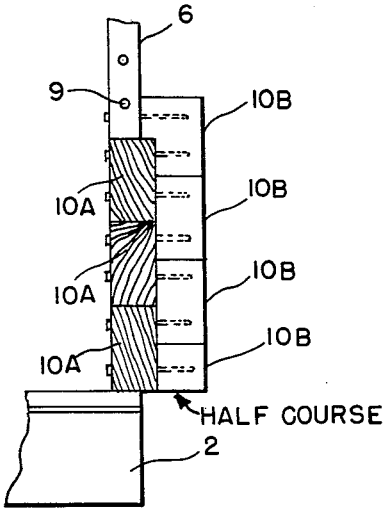
FIG. 4 is a side elevational view of a log corner unit utilizing saddle notched square-shaped log pieces.
Figure 5:
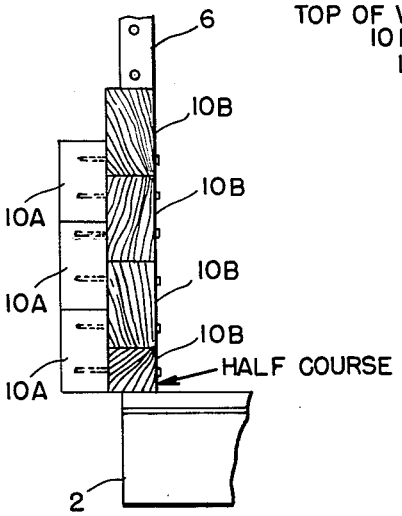
FIG. 5 is a front elevational view of a log corner unit of the type shown in FIG. 4.

FIGS. 4 and 5 illustrate a somewhat differently constructed assembly unit, wherein the end pieces 10A and 10B are saddle notched and square-shaped, and the end pieces 10A are arranged above each other with the flat bottom and top faces of each piece being in snugly abutting relation so as to be alignable with and in effect extensions of the side wall building slabs 22, which correspondingly disposed in abutting relation, but a lowermost end piece 10B is approximately one-half the height of the end pieces 10B thereabove so as to constitute a half course and which end pieces 10B are alignable with and in effect are extensions of the front wall building slabs 22. It will be evident that use of the lowermost half course causes the end pieces 10B thereabove to be staggered or offset horizontally with respect to the end pieces 10A. The uppermost end piece 10A attached to corner beam 6 is of half course height so as to abut the flat upper face of the end piece 10A therebelow and cause the top end pieces 10A–10B to be aligned at the roof line or top plate of the structure. Thus, this arrangement of corner unit end pieces 10A–10B will give the appearance to the siding walls of being formed at their corners of closely nested generally rounded and notched log courses which intersect at their corners utilizing the saddle notched log design.

Figure 6:
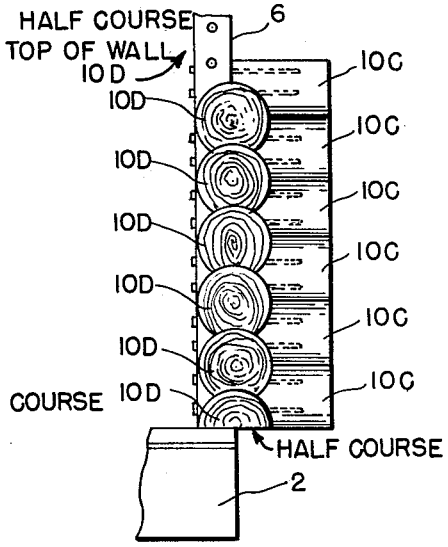
FIG. 6 is a side elevational view of a log corner unit utilizing saddle notched round log pieces.
Figure 7:
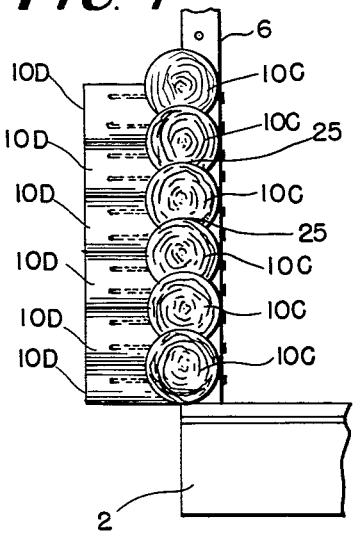
FIG. 7 is a front elevational view of a log corner unit of the type shown in FIG. 6.

In the embodiment of FIGS. 6 and 7, each end piece 10C and 10D is generally circular in cross section, with each underside of each of the end pieces 10C–10D being notched to provide a concave recess 25 to snugly receive the curved upper surface of the next succeeding end piece therebelow. In this embodiment, the end pieces 10C are arranged above each other in abutting relation so as to be alignable with the correspondingly abutting side wall building slabs 22, which correspondingly have convex exterior faces, and are in effect extensions thereof. The end pieces 10D are also disposed in abutting relation, but the lowermost end piece 10D thereof is a half course with a convex upper face which interfits the notched underside of the next succeeding end piece 10D thereabove so that these end pieces 10D are aligned with and function as extensions of the front wall building slabs 22. In this embodiment, use of the lowermost half course end piece 10D, causes the end pieces 10D thereabove to be staggered or offset with respect to the end pieces 10C. Thus, it is desirable that the uppermost end piece 10C be of half course height so that in abutting with the end piece 10D therebelow, the upper faces of the top end pieces 10C–10D will be on the same horizontal plane. Accordingly, and as with the embodiment of FIGS. 4–5, this arrangement will give the appearance to the walls of being formed of closely nested generally rounded and notched log courses which intersect at their corners.

Figure 2:
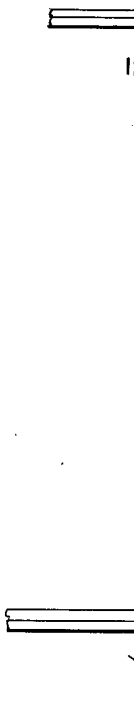
Figure 3:
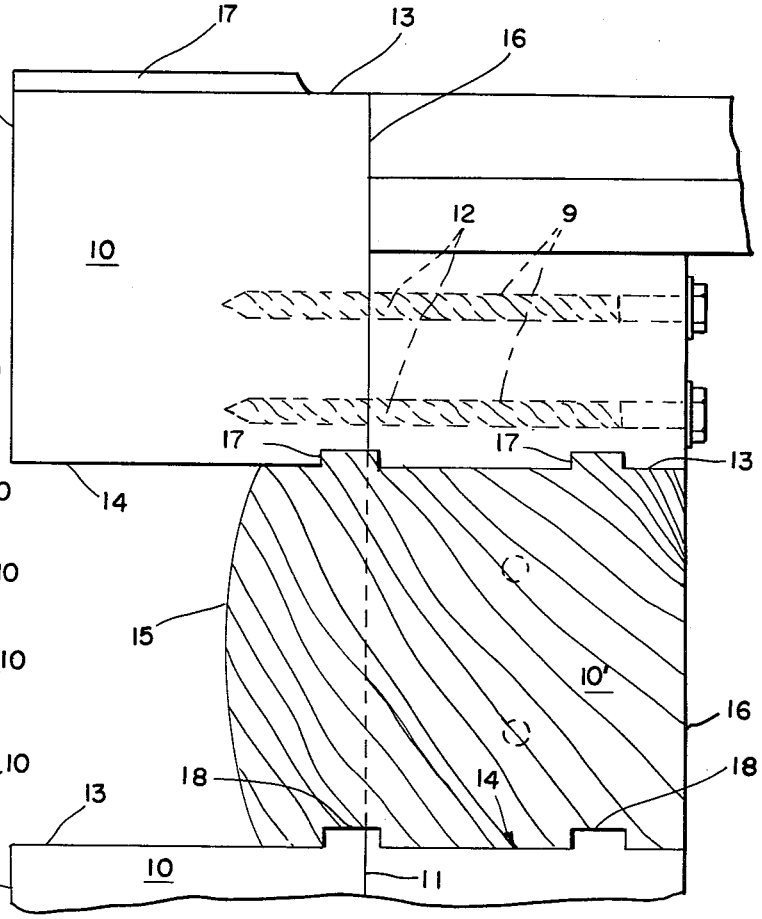
Figure 8:
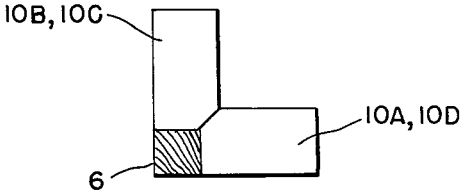
FIG. 8 is a top plan view showing the positions assumed by the log pieces in the embodiments of FIGS. 4–7.
Figure 9:
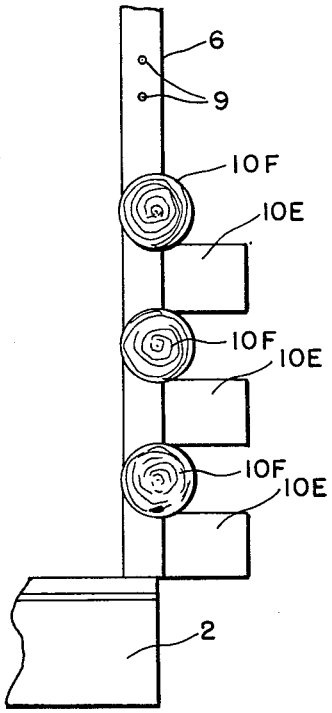
FIG. 9 is a side elevational view of a log corner unit utilizing alternate overlapped round log pieces.
Figure 10:
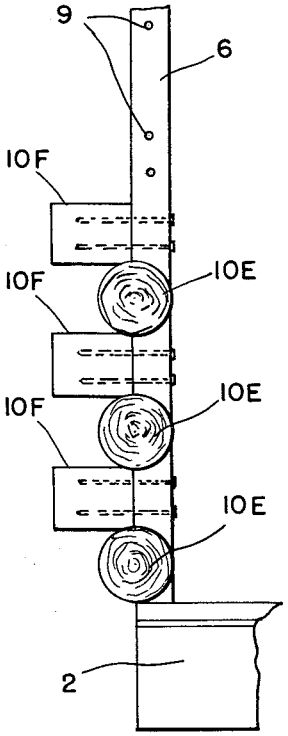
FIG. 10 is a front elevational view of a log corner unit of the type shown in FIG. 8.

Another corner assembly unit embodiment is shown in FIGS. 8 and 9, wherein the end pieces 10E and 10F are circular, with alternate log end pieces overlapping, generally as those of FIGS. 1–3. In such an arrangement, the siding courses may be formed by severing appropriately sized logs lengthwise in half so that each will have a flat interior wall and concave exterior. Such log siding log halves may be attached to the exterior sheathing 21 on each wall, so that, viewing the front wall, and beginning at the top, the uppermost siding course extending thereacross will abut and is adhesively attached to a flat inside wall 7″ of a corner assembly unit beam 6. Thus, that top siding course will be in alignment with the uppermost laterally extending log end piece 10F, and alternate siding courses therebelow will similarly abut wall 7″ in alignment with the other laterally extending log end pieces 10F. The siding course immediately below the uppermost course will abut the beam on the same plane with the topmost forwardly projecting log end piece 10E, so that the latter will be disposed at right angles thereto, and alternate siding courses therebelow will correspondingly engage the beam on the same planes with the other forwardly extending log end pieces 10E. By virtue of this arrangement, it will be apparent that the siding courses on the left side, for example, beginning with the uppermost course, will abut the corner unit beam so that the top log end piece 10F of the left front corner unit will be disposed at right angles thereto, with the siding courses therebelow engaging the beam so that the remaining log end pieces 10F and 10E will either be in alignment with or at right angles thereto. This results in the log end pieces being staggered with reference to the respective left and front wall siding courses and will give the appearance thereto of log courses intersecting at each corner.

It is to be understood that the corner unit log end pieces may be variously contoured and finished so as to be compatible with the particular shaped siding being utilized. Regardless of the corner assembly units employed, the resulting structure will simulate the finished appearance of a log cabin.

While various embodiments of corner assembly units have been shown and described, it is to be further understood that various changes and improvements may be made therein, without departing from the scope and spirit of the appended claims.

What I claim is:

1. In a simulated log corner assembly unit for constructing log cabin type structures from preformed log siding on foundations with wall framing erected thereon, one of said units being arranged at each corner of the foundation and each comprising a vertically disposed beam, a series of relatively short simulated log end pieces attached to said beam generally at right angles thereto and relative to each other, some of said pieces projecting forwardly from said beam and some of said pieces projecting laterally therefrom, said log siding being arranged in adjacent horizontal courses and extending between said corner assembly units to form the walls thereof, the ends of said siding courses abutting and attached to said beams so that said end pieces will project forwardly and laterally therefrom in relationship to said siding courses and whereby said end pieces will simulate the intersecting corner ends of said siding courses and simulate the finished look of a structure constructed from regular logs.

2. In a simulated log corner assembly unit according to claim 1, wherein said beams are spacedly bored therethrough, and attaching means extends through said bores to attach said log end pieces to said beams.

3. In a simulated log corner assembly unit according to claim 2, wherein said beams are elongated and are generally rectangular in cross section to provide flat walls, and said log end pieces abut and are attached to said flat walls.

4. In a simulated log corner assembly unit according to claim 3, wherein said log end pieces are shaped in cross section to simulate logs, and said pieces have flat opposing ends.

5. In a simulated log corner assembly unit according to claim 1, wherein said end pieces are offsettedly and spacedly attached to said beam, and alternate of said pieces project forwardly from said beam, and said pieces interposed therebetween project laterally therefrom, whereby said end pieces alternately project forwardly and laterally from said beams in alternate alignment with said siding courses.

6. In a simulated log corner assembly unit according to claim 1, wherein said end pieces are generally rectangular in shape.

7. In a simulated log corner assembly unit according to claim 1, wherein said end pieces are generally rectangular in shape to provide generally flat upper, lower and one side wall, and wherein the remaining side wall is generally convex.

8. In a simulated log corner assembly unit according to claim 1, wherein said end pieces are generally annular in cross section.

9. In a simulated log corner assembly unit according to claim 4, wherein said lag screw means project through said bores and into the flat end walls of said end pieces with adhesive means applied thereon for securely attaching said end pieces to said beam.

* * * * *